US005361486A

United States Patent [19]

Harmsen et al.

[11] Patent Number: 5,361,486

[45] Date of Patent: Nov. 8, 1994

[54] SYSTEM OF MACHINING DEVICES

[75] Inventors: Johannes G. T. Harmsen, Didam; Willem A. De Boer, Westervoort, both of Netherlands

[73] Assignee: ASM-FICO Tooling B.V., Ad Herwen, Netherlands

[21] Appl. No.: 50,397

[22] PCT Filed: Sep. 2, 1991

[86] PCT No.: PCT/EP91/01668

§ 371 Date: Aug. 20, 1993

§ 102(e) Date: Aug. 20, 1993

[87] PCT Pub. No.: WO92/04145

PCT Pub. Date: Mar. 19, 1992

[30] Foreign Application Priority Data

Sep. 11, 1990 [NL] Netherlands ..... 9001999

[51] Int. Cl.[5] ..... B23P 23/00; B23Q 7/14; B21D 43/00

[52] U.S. Cl. ..... 29/563; 29/564; 29/759; 29/827

[58] Field of Search ..... 29/564, 759, 564.2, 29/564.7, 566.3, 783, 827, 563; 72/341, 452

[56] References Cited

U.S. PATENT DOCUMENTS

| | | | |
|---|---|---|---|
| 3,481,235 | 12/1969 | Kaufman et al. | 83/58 |
| 3,728,597 | 4/1973 | Cummens et al. | 318/85 |
| 4,429,559 | 2/1984 | Depuglia et al. | 72/186 |
| 4,516,673 | 5/1985 | Kashihara et al. | 29/759 X |
| 4,885,837 | 12/1989 | Eshima et al. | 29/564 |
| 4,923,386 | 5/1990 | Eshima et al. | 425/450 |

FOREIGN PATENT DOCUMENTS

| | | | |
|---|---|---|---|
| 61-069661 | 4/1986 | Japan | B65H 35/4 |
| 155154 | 7/1991 | Japan | 29/827 |
| 5050171 | 3/1993 | Japan | 29/827 |

OTHER PUBLICATIONS

Patent Abstracts of Japan, vol. 11, No. 224 (M-609) (2672), 22 Jul. 1987 & JP-A-62 039 107 (Matsumura), 20 Feb. 1987.

Patent Abstracts of Japan, vol. 10, No. 233 (E-427) (2289), 13 Aug. 1986 & JP-A-61 065 461 (Matsumura), 4 Apr. 1986.

Patent Abstracts of Japan, vol. 11, No. 294 (E-544) (2741), 22 Sep. 1987 & JP-A-62 093 967 (Toei Seiko), 30 Apr. 1987.

*Primary Examiner*—William Briggs

*Attorney, Agent, or Firm*—Limbach & Limbach

[57] ABSTRACT

A system of machining lead frames (7), such as punching, cutting and bending of the leads consists of a number of machining devices (1, 2, 3) placed in series. Transport means (8) are provided for transporting the lead frames between the successive machining device. Each device comprises means for transporting the lead frames in horizontal and vertical direction, a tool carrier driving means for driving the tool carrier (18). Further, a control device (4) is provided for controlling, synchronizing and protecting the operation of the machining devices. The machining devices are purely mechanically driven and the system is a device on a modular basis.

13 Claims, 6 Drawing Sheets

SYSTEM OF MACHINING DEVICES

BACKGROUND OF THE INVENTION

The invention relates to a system of machining devices particularly for machining so-called lead frames, such as punching, cutting and bending. Such lead frames are intended for carrying chips. The intended processes to be performed on the lead frames are performed in a so-called cutting and bending machine. Such a cutting and bending machine needs to combine great accuracy with the highest possible machining speed. For machining the lead frames are carried by means of transporting means through the machine, placed on a machining station and subjected to a machining, whereafter the transporting means pick up the lead frames again and transport them to a following station. The entire process takes place automatically.

In older machines the machine tool is driven via pneumatic means in order to perform an active stroke. A pneumatic cylinder coupled to the tool carrier is employed for this purpose. Later machines were driven via hydraulic means since the forces generated therewith are greater than the forces obtained via pneumatic means. A complication in such a type of device is that a comparatively large stroke length is required since the transporting means require a free passage in order to be able to place the lead frame on a machining station and then pick it up again. It is furthermore desirable to be able to visually inspect the machining zone.

The hydraulic driving also has other different drawbacks. Firstly, the use of a hydraulic medium is not easily compatible with the clean environment in which the process must take place. In addition, the accuracy of the movement via hydraulic means is limited, since this movement is only guided by one guide, the hydraulic piston rod. In the past different steps have been taken to increase this accuracy, but the possibilities are limited. Should it be desired to further increase the speed, the hydraulic drive imposes limits, since the speed is limited among other reasons because the driving hydraulic medium has to surmount a dead point during a complete cycle of the active stroke. The result is that the transport of the lead frame can only be performed when it has been established that the stroke of the tool has ended at a predetermined position.

SUMMARY OF THE INVENTION

The invention has further for its object to obviate the above mentioned drawbacks. Particular objectives here must be a great stroke length, a high speed, a clean operating environment and great accuracy of the movement of the tool relative to the lead frame.

From JP-A-6165461 a cutting device as defined in the preamble of claim 1 is known.

Besides cutting the leads of a lead frame other operations should be machined, such as bending and punching. Thereto, according to the prior art, the lead frame should be taken out from such a machine and it should be placed in another machining device.

It is the object of the invention to provide an integrated system in which all the necessary operations are being carried out automatically in a controlled way.

The above object is achieved according to the invention by a system of the type which includes machining devices placed in series, particularly for machining lead frames, such as by punching, cutting and bending, and means for transporting the lead frames for machining along a transport path between successive machining devices. In accordance with the present invention, each machining device comprises a main frame, a tool carrier carrying a tool and movable substantially perpendicularly to the transport path for performing an active stroke, a member driving the tool carrier, the member being an eccentric rotatably drive by a motor, mounted in the main frame of the machining device and coupled to a main shaft, transport means, driven by a cam disc placed on the main shaft, for transporting the lead frames in horizontal and vertical directions in the machining device, and a control device coupled to the machining devices for controlling the operation of the machining devices.

By providing an integrated modular automatically operating system a economically suitable way of performing operations is obtained.

The modular construction furnishes great advantages, particularly in production. The machining devices can be separately produced and tested. They can then be assembled into a desired system. This provides a great degree of flexibility.

The member driving the tool carrier is preferably formed by an eccentric rotatably driven by a motor and situated in the main frame of the machining device.

A continuous movement is obtained by this method of driving, which allows a higher machining speed. Such a drive method is possible since the forces to be exerted for the machining are limited.

Coupled to the eccentric and connected to the tool carrier is an auxiliary frame, which is vertically guided in the main frame for performing relative to the main frame an active stroke performed between two end positions.

The end positions of the auxiliary frame are adjustable relative to the main frame. The option is therefore available of having the active stroke performed relative to the machining surface at a position where this is deemed desirable. The stroke depth can hereby be regulated. In addition, with a view to inspection, the working surface can be made entirely visually accessible as desired.

The setting of the end positions of the auxiliary frame preferably takes place by means of a shaft rotatable in the main frame and driven by a stepping motor, which shaft is coupled to the auxiliary frame over a screw connection. By using a stepping motor and a very fine screw thread connection a very accurate adjustment of the end position of the auxiliary frame can be obtained.

The shaft is preferably a keyway shaft and is received for vertical movement in a belt pulley driven rotatably by the stepping motor.

For synchronously controlling the machining devices and the operation of the transport means the control device is coupled to sensors which detect the angle position of the eccentric in each of the machining devices. The system of machining devices is controlled on the basis of the information obtained under the control of software in the microprocessor incorporated in the control device.

The transport means for horizontal and vertical transport in the machining device are driven by a cam disc placed on the main shaft.

For driving of the transport means for horizontal transport the ridge disc is coupled over a fork-shaped member, which performs a linear movement when the cam disc rotates, to a pinion and a toothed rack, wherein the toothed rack, by means of a lever eccentrically connected to the toothed rack, provides a reciprocating movement of the transport means slidable along guide tracks.

For driving of the vertical transport the main shaft is coupled to cam discs disposed in parallel which drive operating members moving guide tracks for horizontal transport of a lead frame between end positions is in vertical direction.

To avoid damage the system preferably contains a sensor connected to a release mechanism for a coupling between the drive motor and the main shaft for detecting an overload in the drive of the tool.

In order to ensure that after decoupling the device comes rapidly to a standstill, a brake coupled to the eccentric is energized at release of the coupling when an overload is detected.

For the transport between the machining devices the transport means consist of an endless belt with a feed and for receiving a lead frame passed on by the horizontal transport means of a preceding machining device and a discharge and for transferring a lead frame to the horizontal transport means of a following machining device, a stop for a lead frame placed above the endless belt, wherein the material of the endless belt has a friction coefficient such that, when the lead frame strikes against the step, the belt slips relative to the lead frame.

The invention will be further elucidated with reference to the drawings.

DETAILED DESCRIPTION OF THE PREFERRED EMBODIMENT

Figure 1:
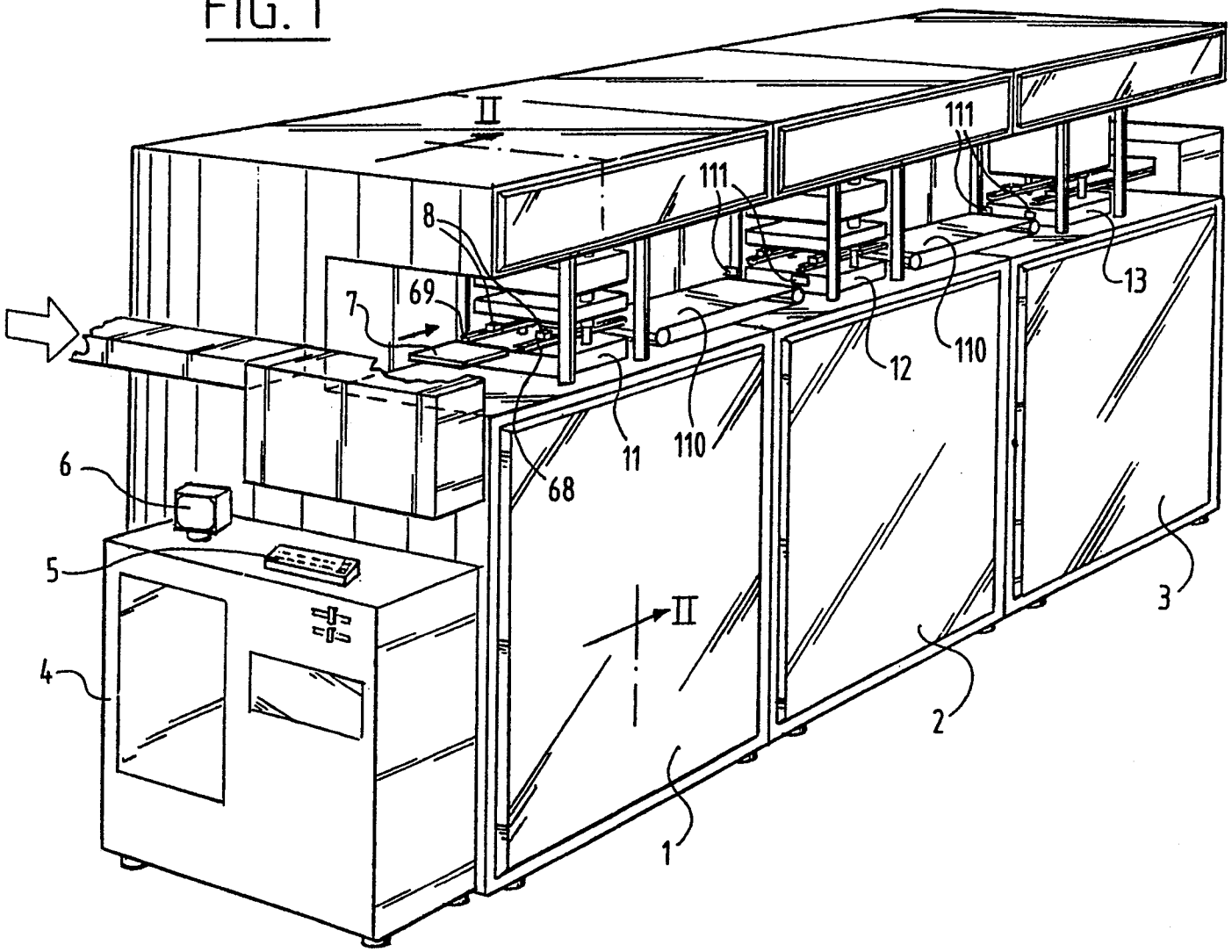
FIG. 1 shows a schematic perspective view of a system according to the invention.

Referring now to FIG. 1, the system according to the invention comprises machining devices 1, 2, 3 accommodated in cabinet-like units 1, 2, 3, the operation of which devices is controlled and mutually synchronized from the control module 4. A microprocessor is incorporated in the control module 4. The control module 4 has a control panel 5 and a control unit in the form of a monitor 6.

Figure 2:
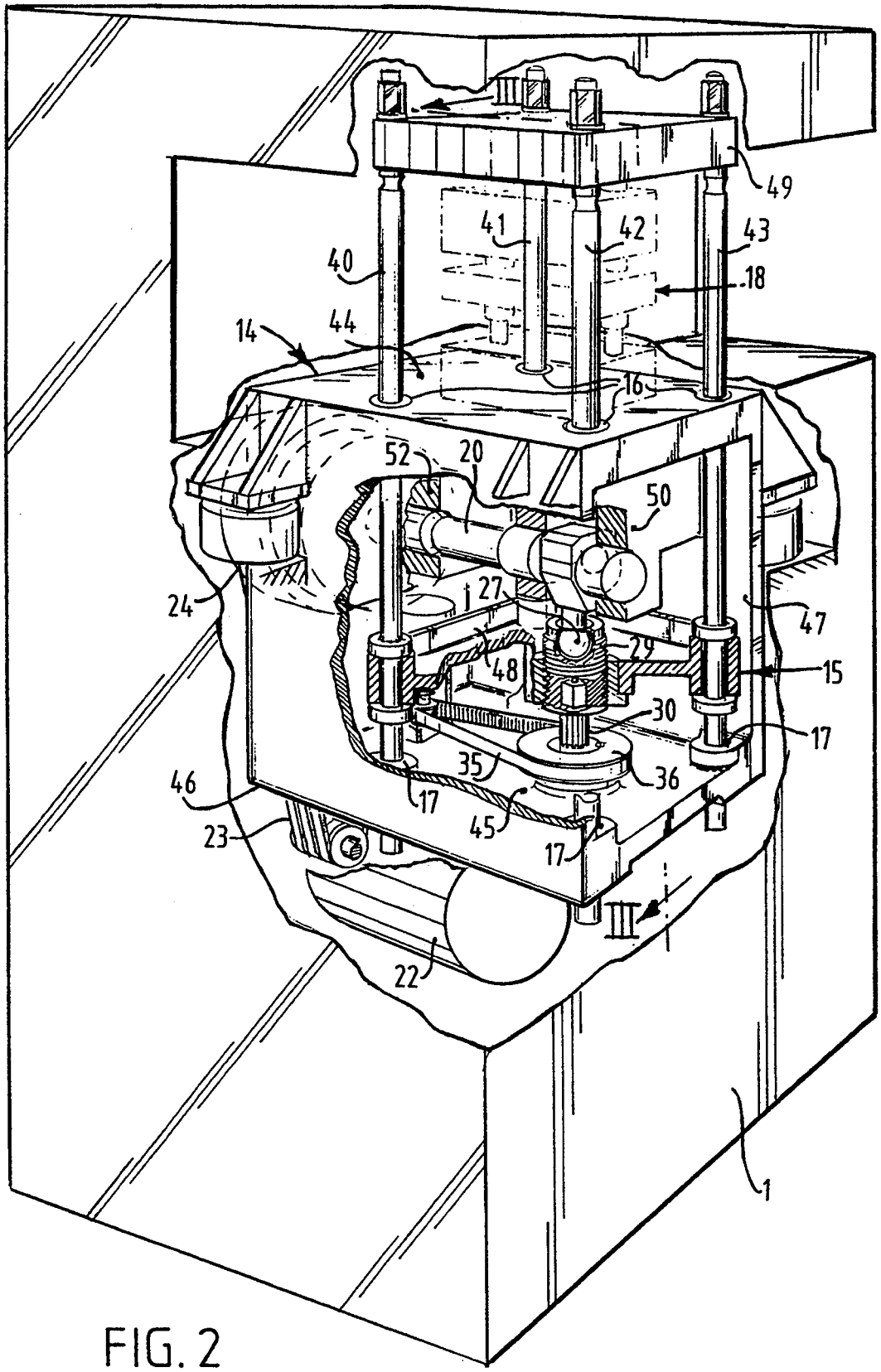
FIG. 2 shows a perspective cut away view according to the line II—II in FIG. 1.
Figure 3:
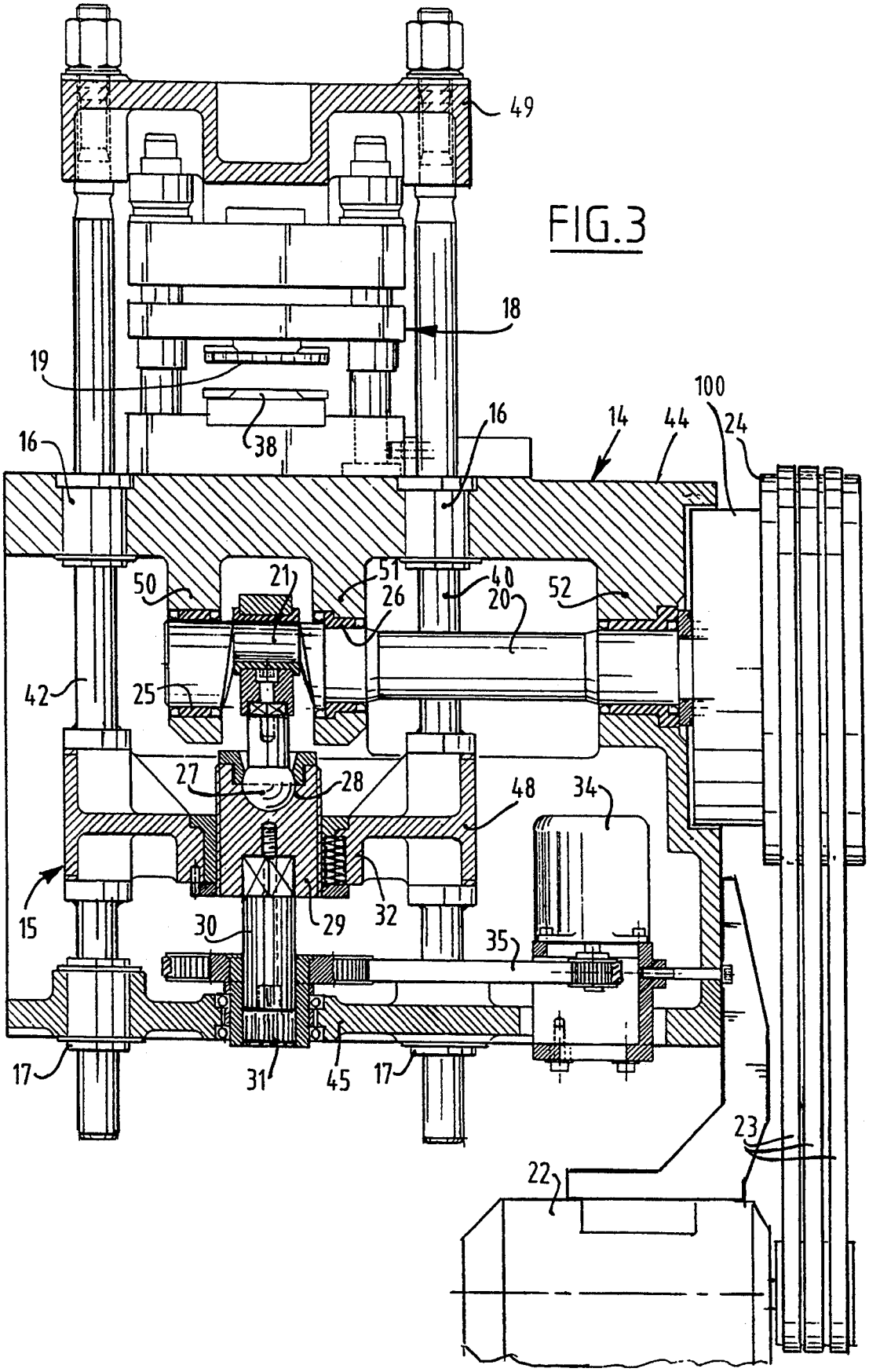
FIG. 3 is a sectional view along the line III—III from FIG. 2.

The lead frame 7 for machining is transported by means of a transport means 8 which is movable over lengthwise guides 68 and 69 in a machining device. At the location of each machining device 1, 2, 3 is a machining station 11, 12, 13 respectively, where the various required processes, including punching, bending, cutting and the like, can be performed. As best shown in FIGS. 2 and 3, each machining device comprises at least a main frame 14 and an auxiliary frame 15 that is movable vertically relative to the main frame 14 with guide rods 40, 41, 42, 43 in bearings 16, 17. The main frame comprises transverse bearers 44, 45 which are connected at a distance by vertical walls 46, 47. The bearings 16, 17 are arranged in the transverse bearers 44 and 45 respectively.

Figure 4:
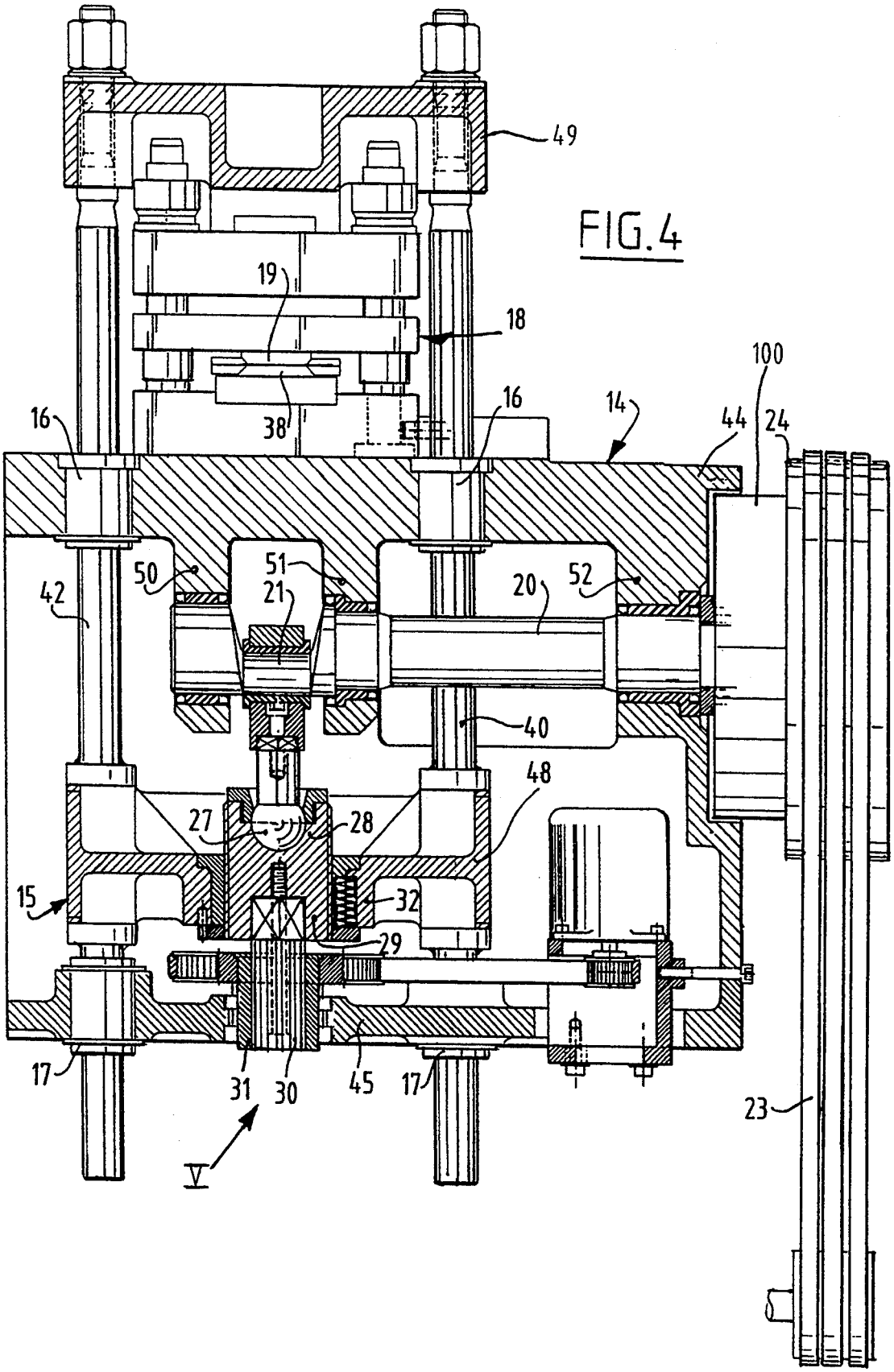
FIG. 4 shows a similar view to FIG. 3, but in another of the end positions of the auxiliary frame.

The auxiliary frame 15 comprises a horizontally running, lower coupling member 48 connected to the guide rods 40, 41, 42 43 and, arranged at a vertical distance therefrom, an upper coupling member 49 that is likewise fixedly connected to the guide rods 40, 41, 42, 43. The tool consists of a tool carrier 18 bearing a tool 19 and a work surface 38 co-acting therewith. Coupled to the upper coupling member 49 of the auxiliary frame 15 is a tool carrier 18 in which a desired tool 19 is placed. A shaft 20 which carries an eccentric 21 is received rotatably in protruding parts 50, 51, 52 on the transverse bearer 44 of the main frame 14. The shaft 20 is driven from the motor 22 via a transmission 23 and a belt pulley 24. The eccentric 21 is mounted in bearings 25, 26 of the protruding parts 50 and 51 respectively. The eccentric carriers a spherical pivot 27 resting in an adapted bearing socket 28. With a rotation of the shaft 20 the eccentric, and therefore the auxiliary frame 15, moves between two ends positions, one of which is drawn in FIG. 3 and the other in FIG. 4. These end positions respectively correspond to the open position of the machine tool 19 and the closed position thereof.

Figure 5:
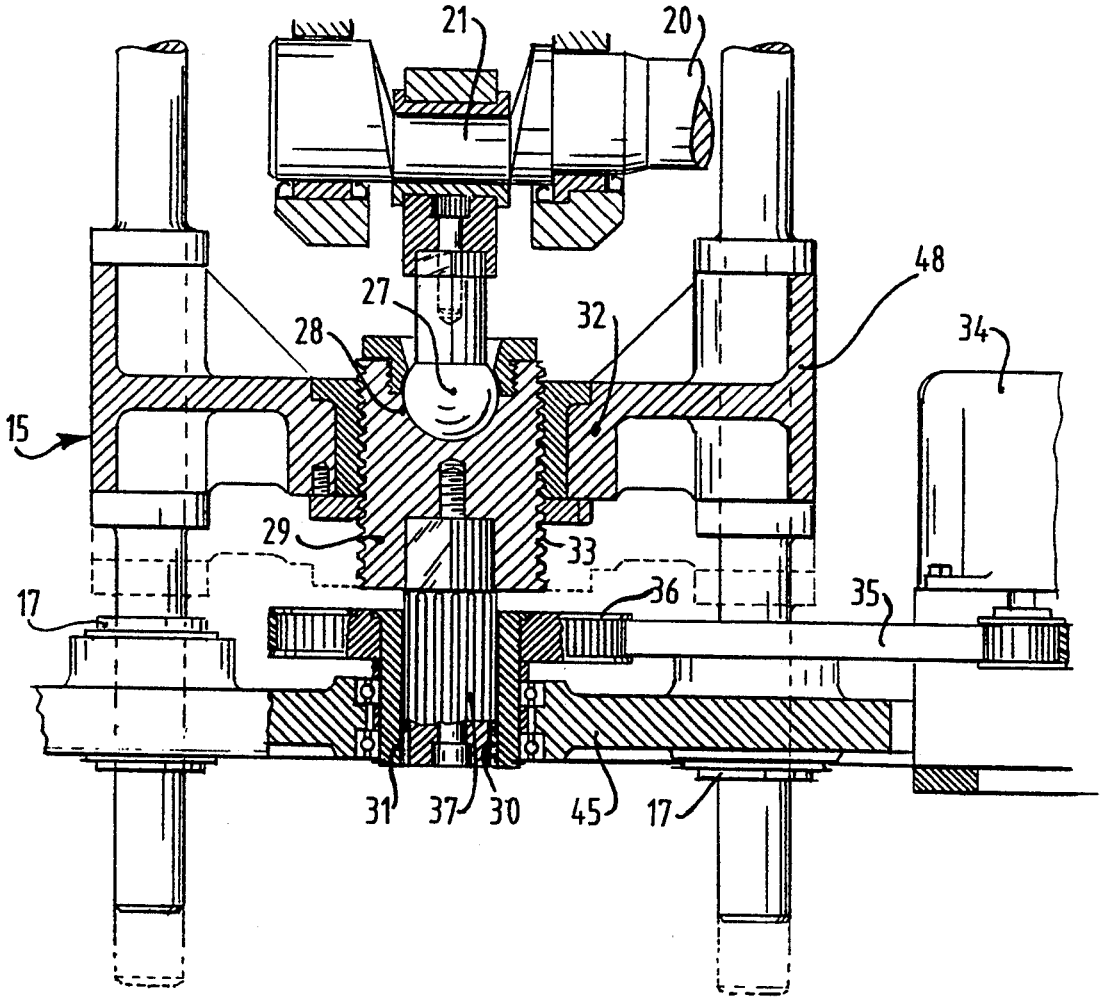
FIG. 5 shows a detail V from FIG. 4.

During the movement between both end positions a part 29 of the auxiliary frame 15 moves with the shaft 30 coupled thereto in a bearing 31 in the transverse bearer of the main frame. The coupling between the part of the shaft 30 and the auxiliary frame 15, in any case the flange shaped portion 32 thereof, runs via a screw thread connection 33 (FIG. 5). Using the stepping motor 34 the belt pulley 36 can be rotated via the drive belt 35. Because the shaft 37 has a keyway 37 which co-acts with corresponding ribs on the inside of the bearing 31, the shaft 30 rotates with the belt pulley 36 therein carrying with it the part 29. Due to this rotation movement the part 32 of the auxiliary frame and the part 33 move in a lengthwise direction relative to one another so that the auxiliary frame 15 undergoes a vertical movement. Indicated with broken lines in FIG. 5 is the position of the auxiliary frame relative to the part 29 in the situation according to FIG. 3 and 4. In the present embodiment as according to FIG. 5 the auxiliary frame 15 is moved in upward direction so that the work surface 38 is completely accessible. A subsequent active stroke of the eccentric 21 and therefore the auxiliary frame 15 will thus produce a higher lying end position of the machine tool 19 than in the position indicated in FIG. 3 and 4. In the manner outlined in the foregoing, the depth of the active stroke can therefore be accurately controlled.

Figure 6:
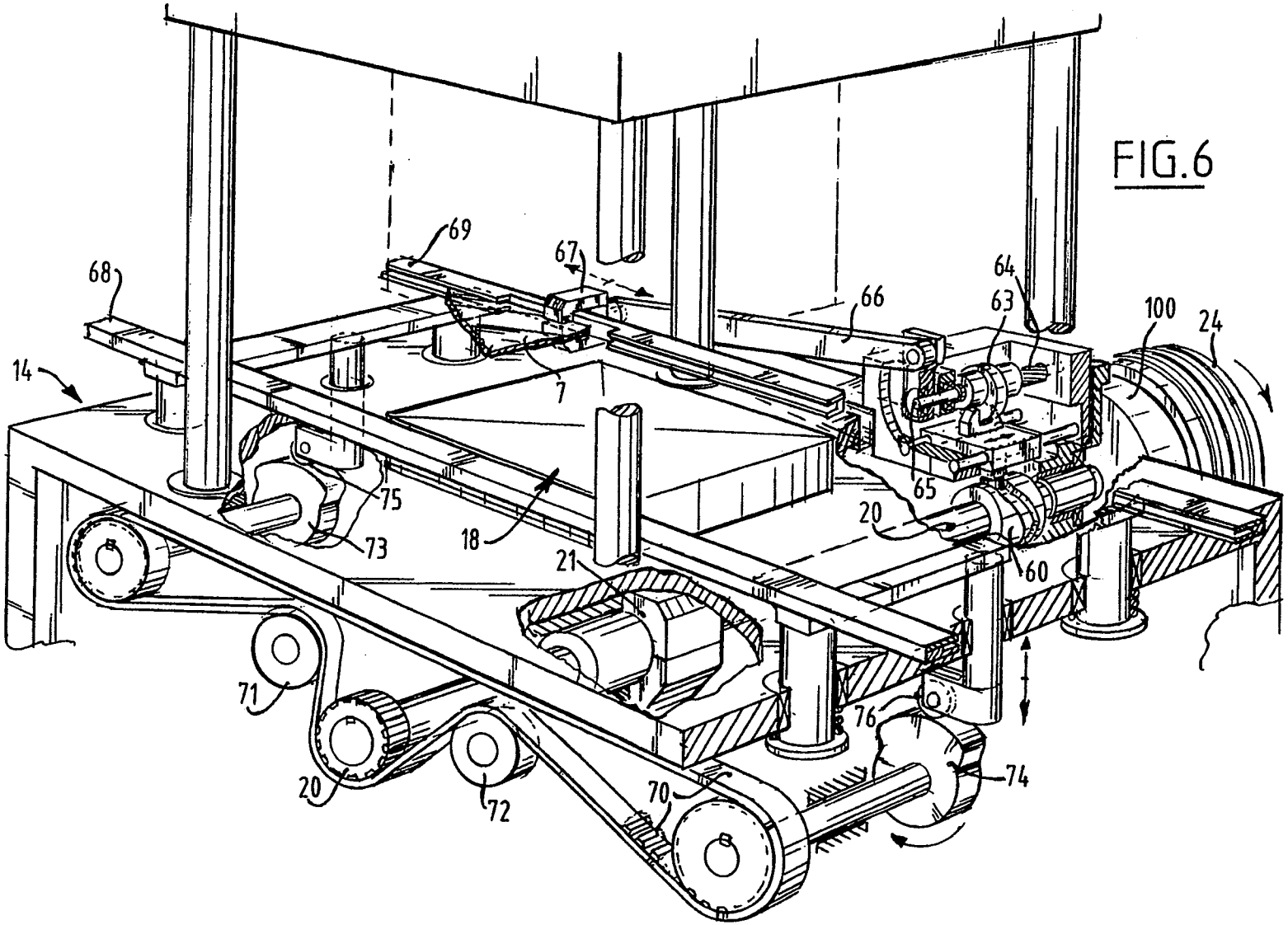
FIG. 6 shows a perspective view of the horizontal drive and vertical drive of the transport means.

FIG. 6 shows the manner of transport into a machining device.

Placed on the main shaft 20 is a cam disc 60 which co-acts with a fork-shaped member 61 such that with a rotation movement of the cam disc 60 the fork-shaped member performs a linear reciprocating movement according to the arrows shown. The fork-shaped member 61 carries with it during the linear movement a pinion 63 which engages on a worm gear 64 which is coupled to a shaft 65. Due to the reciprocating movement of the worm wheel 63 the worm gear 64 rotates, as does the shaft 65 therefore which is mounted in the frame. A lever 66 is eccentrically coupled to the shaft 65. At a rotation movement of the shaft 65, the lever performs a reciprocating movement between two end positions. The lever is coupled at the end with drive means 67 which move the transport means reciprocally along the guide track 69.

There is therefore a one-way coupling between the movement of the horizontal transport means and the rotation of the main shaft 20 so that complete synchronization with the movement of the tool of the machining device is ensured.

As can be seen, there is also a one-way coupling between the vertical transport of the lead frame in the machining device and the rotation of the main shaft 20. The main shaft 20 is coupled to the cam discs 73, 74 by an endless drive belt 70 which is trained over belt pulleys 71, 72. When the main shaft 20 rotates, the cam discs 73, 74 are driven. The cam discs 73, 74 rotating synchronously and in phase impart to the drive members 75, 76 a vertical movement between two end positions. The members 75, 76 are coupled to the respective guide tracks 68, 69 so that these likewise undergo a vertical movement.

Because both the horizontal and the vertical transport is derived from the main shaft 20 a complete synchronization between the mutual movements and the movement of the tool is ensured.

A releasing mechanism is arranged in the coupling 100 between the shaft of the driving belt pulley 24 and the main shaft 20. The coupling is connected via means (not drawn) to an overload sensor which measures the load of the drive of the tool. In the case of overloading as a result for example of incorrect placing of a lead frame, the release mechanism of the coupling 100, controlled by a signal from the sensor, is set into operation and therefore releases the shaft 20 from the drive shaft. A brake (not shown) of for instance pneumatic type also comes into operation which brings the main shaft and therefore the eccentric to a standstill within a very short period of time.

Finally, it is noted that for transport between the machining devices use is made of a buffer transporter 110. Such a buffer transporter 110 consists of an endless belt conveyor and a stop 111. During operation a lead frame is placed on the endless belt conveyor 110 by the horizontal transport means of a preceding machining device. The lead frame moves over the belt conveyor 110 until it meets the stop 111. After the lead frame has come to a standstill against the stop, the belt slips under the lead frame. The horizontal transport means of a following machining device take the lead frame at a suitable moment in time from the belt conveyor 110 and carry it to the machining location on the following machining device.

We claim:

1. A system of the type which includes machining devices placed in series, particularly for machining lead frames, such as by punching, cutting and bending, and means for transporting the lead frames for machining along a transport path between successive machining devices, wherein each machining device comprises:

a main frame, a tool carrier carrying a tool and movable substantially perpendicularly to the transport path for performing an active stroke.

a member driving the tool carrier, the member being an eccentric rotatably driven by a motor, mounted in the main frame of the machining device and coupled to a main shaft, transport means, driven by a cam disc placed on the main shaft, for transporting the lead frames in horizontal and vertical directions in the machining device, and a control device coupled to the machining devices for controlling the operation of the machining devices.

2. A system as claimed in claim 1, wherein an auxiliary frame connected to the tool carrier is coupled to the eccentric, which auxiliary frame is guided vertically in the main frame for performing relative to the main frame an active stroke performed between two end positions.

3. A system as claimed in claim 2, wherein the end positions of the auxiliary frame are adjustable relative to the main frame.

4. A system as claimed in claim 3, wherein the setting of the end positions of the auxiliary frame take place by means of a shaft rotatable in the main frame and driven by a stepping motor, which shaft is coupled to the auxiliary frame via a screw thread connection.

5. A system as claimed in claim 4, wherein the shaft is a keyway shaft and is received for vertical movement in a belt pulley rotatably driven by the stepping motor.

6. A system as claimed in claim 3, wherein the control device is coupled to sensors detecting the angle position of the eccentric, the control device contains a microprocessor, and software is incorporated in the microprocessor to synchronize the operation of the transport means and the driving of the eccentric and the stepping motor.

7. A system as claimed in claim 1, wherein for transporting the lead frames in the horizontal direction, the cam disc is coupled via a fork-shaped member, which performs a linear movement when the cam disc is rotated, to a pinion and toothed rack, and by means of a lever eccentrically connected thereto the toothed rack imparts a reciprocating movement to the transport means slidable along guide tracks.

8. A system as claimed in claim 1, wherein for transporting the lead frames in the vertical direction, the main shaft is coupled to cam discs disposed in parallel which drive operating members moving guide tracks for the horizontal transport of a lead frame between end positions in the vertical direction.

9. A system as claimed in claim 1, further comprising a sensor connected to a release mechanism for a coupling between the motor and the main shaft for detecting an overload in the drive of the tool.

10. A system as claimed in claim 9, wherein when the coupling is releaed when overload is detected, a brake coupled to the main shaft is energized.

11. A system as claimed in claim 10, wherein the brake is of the pneumatic type.

12. A system as claimed in claim 1, wherein the transport means includes a horizontal transport means for transporting the lead frames in a horizontal direction in the machining device, and the means for transporting the lead frames for machining along a transport path between successive machining devices includes an endless belt with a feed end for receiving a lead frame passed on by the horizontal transport means of a preceding machining device and a discharge end for transferring a lead frame to the horizontal transport means of a following machining device, and a stop for a lead frame placed above the endless belt, wherein the material of the endless belt has a friction coefficient such that when the lead frame strikes against the stop, the belt slips relative to the lead frame.

13. A system comprising:

a plurality of machining devices placed in series along a transport path, particularly for machining lead frames, such as by punching, cutting and bending, wherein each machining device includes:

a main frame, a horizontal transport means for transporting the lead frames in a horizontal direction in the machining device, a vertical transport means for transporting the lead frames in a vertical direction in the machining device, a tool carrier carrying a tool and movable substantially perpendicularly to the transport path for performing an active stroke, and a member driving the tool carrier;

path transport means for transporting the lead frames for machining along the transport path between the machining devices, the path transport means including an endless belt with a feed end for receiving a lead frame passed on by the horizontal transport means of a preceding machining device and a discharge end for transferring a lead frame to the horizontal transport means of a following machining device, and a stop for a lead frame placed above the endless belt, wherein the material of the endless belt has a friction coefficient such that when the lead frame strokes against the stop the belt slips relative to the lead frame; and a control device coupled to the machining devices for controlling the operation of the machining devices.

* * * * *